US008480379B2

(12) United States Patent
Moriyama et al.

(10) Patent No.: US 8,480,379 B2
(45) Date of Patent: Jul. 9, 2013

(54) VACUUM PUMP

(75) Inventors: Nobuhiko Moriyama, Kyoto (JP); Yoshihiro Nagano, Kyoto (JP); Junichiro Kozaki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 370 days.

(21) Appl. No.: 12/851,171

(22) Filed: Aug. 5, 2010

(65) Prior Publication Data

US 2010/0303644 A1 Dec. 2, 2010

(30) Foreign Application Priority Data

Jan. 22, 2008 (JP) ..... 2008-011143

(51) Int. Cl.
*F04B 39/04* (2006.01)
*F04B 39/06* (2006.01)

(52) U.S. Cl.
USPC ..... 417/228; 417/423.8; 310/53

(58) Field of Classification Search
USPC ..... 417/228, 423.8, 13, 366, 367; 310/53, 310/54; 361/178; 340/602
See application file for complete search history.

(56) References Cited

U.S. PATENT DOCUMENTS

| | | | | |
|---|---|---|---|---|
| 4,512,161 | A * | 4/1985 | Logan et al. | 62/176.6 |
| 4,526,011 | A * | 7/1985 | Logan et al. | 62/176.1 |
| 5,090,210 | A * | 2/1992 | Katayanagi et al. | 62/135 |
| 5,116,203 | A * | 5/1992 | Natwick et al. | 417/53 |
| 5,123,478 | A * | 6/1992 | Hosaka | 165/292 |
| 5,144,811 | A * | 9/1992 | Brodie et al. | 62/176.6 |
| 6,196,003 | B1 * | 3/2001 | Macias et al. | 62/3.7 |
| 6,483,078 | B2 * | 11/2002 | Sullivan | 219/209 |
| 6,853,305 | B2 * | 2/2005 | Acosta-Geraldino et al. | 340/604 |
| 7,174,738 | B2 * | 2/2007 | Scott | 62/259.2 |
| 7,886,983 | B2 * | 2/2011 | Criss et al. | 236/44 C |
| 2006/0168991 | A1 * | 8/2006 | Harm | 62/434 |
| 2006/0176663 | A1 * | 8/2006 | McEwan | 361/687 |
| 2006/0260938 | A1 * | 11/2006 | Petrach | 204/298.16 |
| 2007/0171955 | A1 * | 7/2007 | Kanai et al. | 374/28 |
| 2007/0268664 | A1 * | 11/2007 | Kobayashi | 361/695 |
| 2008/0304236 | A1 * | 12/2008 | Murakami et al. | 361/699 |
| 2009/0093219 | A1 * | 4/2009 | Katada et al. | 455/69 |
| 2009/0171478 | A1 * | 7/2009 | Wong | 700/13 |
| 2010/0247336 | A1 * | 9/2010 | Nagano et al. | 417/228 |
| 2010/0247350 | A1 * | 9/2010 | Nagano et al. | 417/410.1 |
| 2011/0032489 | A1 * | 2/2011 | Kimoto et al. | 353/56 |
| 2011/0228115 | A1 * | 9/2011 | Ben-Ezra | 348/208.7 |
| 2011/0289362 | A1 * | 11/2011 | Stabile et al. | 714/47.2 |
| 2012/0034066 | A1 * | 2/2012 | Kogame | 415/90 |
| 2012/0181903 | A1 * | 7/2012 | Kato et al. | 310/67 R |

FOREIGN PATENT DOCUMENTS

| | | | |
|---|---|---|---|
| JP | 11-173293 A | | 6/1999 |
| JP | 11173293 | * | 6/1999 |

OTHER PUBLICATIONS

JP11173293_MachineTranslation.*

* cited by examiner

*Primary Examiner* — Devon Kramer
*Assistant Examiner* — Christopher Maxey
(74) *Attorney, Agent, or Firm* — McDermott Will & Emery LLP

(57) ABSTRACT

A condensation sensor is provided within a power supply device that is provided integratedly with a vacuum pump main unit. When the condensation sensor detects condensation within the power supply device, a CPU closes a cooling water valve. This stops the flow of cooling water that flows through the interior of the power supply device, through a cooling water duct.

6 Claims, 8 Drawing Sheets

VACUUM PUMP

CROSS REFERENCE TO RELATED APPLICATION

This application is based on Japanese Patent Application No. 2008-011143 filed Jan. 22, 2008, which is incorporated herein by reference.

FIELD OF TECHNOLOGY

The present invention relates to a vacuum pump that is integrated with a power supply device or that is provided in proximity to a power supply device.

BACKGROUND OF THE INVENTION

In turbomolecular pumps, there are known turbomolecular pumps wherein the turbomolecular pump main unit and the power supply device are integrated. (See, for example, Japanese Unexamined Patent Application Publication the H11-173293 ("JP '293").) Moreover, a process is known wherein, when exhausting gases wherein products tend to adhere to the inside of the pump, a heater and a cooling device are provided in the turbomolecular pump main unit, to control the temperature of the turbomolecular pump main unit to a high temperature of about 70° C.

Because the power supply device has a converter or inverter, which is a heat source, the power supply device requires cooling. In the case of a turbomolecular pump that is used in a clean environment, cooling using cooling water is preferable to fan cooling, and so in the turbomolecular pump described in JP '293, the turbomolecular pump main unit and the power supply device are cooled through a cooling jacket that uses cooling water.

However, normally the power supply device has a semi-closed structure, and thus the temperature of the condensation point within the power supply device is the same as that of the outside air. Because of the turbomolecular pump main unit is maintained at a high temperature, the temperature surrounding the power supply device is relatively warm, while, on the other hand, the power supply device itself is maintained at a relatively low temperature due to the cooling by the cooling jacket. Because of this, there is a tendency for condensation to occur because the temperature of the power supply device is lower than the temperature of the condensation point for the surroundings. When condensation occurs within the power supply device, malfunctions may occur in the power supply device due to short circuits, and the like.

SUMMARY OF THE INVENTION

The invention is a vacuum pump comprising a power supply device that is integrated with a pump main unit, having a cooling medium duct for carrying a flow of a cooling medium within the power supply device; a valve for adjusting the flow rate of the cooling medium within the cooling medium duct; a condensation sensor for detecting condensation within the power supply device; and controlling means for controlling the opening/closing of the valve; wherein: the controlling means, when the condensation sensor has detected condensation within the power supply device, control the degree of opening of the valve to reduce the cooling medium flow rate within the cooling medium duct, or to stop the flow of the cooling medium.

The invention can also be a vacuum pump comprising a power supply device that is integrated with a pump main unit, comprising: a cooling medium duct for carrying a flow of a cooling medium within the pump main unit and the power supply device; a valve for adjusting the flow rate of the cooling medium the cooling medium duct within the pump main unit and the power supply device; a condensation sensor for detecting condensation within the power supply device; and controlling means for controlling the opening/closing of the valve; wherein: the controlling means, when the condensation sensor has detected condensation within the power supply device, fully close the valve after stopping the operation of the vacuum pump.

Additionally, the invention can be a vacuum pump comprising a power supply device that is integrated with a pump main unit, having a cooling medium duct for carrying a flow of a cooling medium within the pump main unit and the power supply device; a valve for adjusting the flow rate of the cooling medium the cooling medium duct within the pump main unit and the power supply device; a condensation sensor for detecting condensation within the power supply device; timing means for timing a condensation occurrence time interval by incrementing during time interval over which the condensation sensor detects condensation within the power supply device and decrementing from the accumulated time during the time interval over which the condensation sensor does not detect condensation within the power supply device; notifying means for providing a notification that condensation has occurred; and controlling means for controlling the opening/closing of the valve; wherein: the notifying means provide notification of the condensation when the time interval that has been timed by the timing means exceeds a first threshold value; and the controlling means fully close the valve after stopping the operation of the vacuum pump when the time interval that has been timed by the timing means exceeds a second threshold value (which is greater than the first threshold value).

An invention as set forth below can be a vacuum pump comprising a power supply device that is integrated with a pump main unit, including a cooling medium duct for carrying a flow of a cooling medium within the pump main unit and the power supply device; a valve for adjusting the flow rate of the cooling medium the cooling medium duct within the pump main unit and the power supply device; a condensation sensor for detecting condensation within the power supply device; timing means for timing a condensation occurrence time interval by incrementing during time interval over which the condensation sensor detects condensation within the power supply device and decrementing from the accumulated time during the time interval over which the condensation sensor does not detect condensation within the power supply device; a temperature sensor for measuring the temperature within the power supply device; and controlling means for controlling the opening/closing of the valve; wherein: the controlling means, when the time interval that has been timed by the timing means exceeds a first threshold value, reduce the cooling medium flow rate within a range wherein the temperature within the power supply device, measured by the temperature sensor, is in a range that is no higher than a particular temperature, and when the time interval timed by the timing means exceeds a second threshold value (which is greater than the first threshold value), fully close the valve after stopping the operation of the vacuum pump.

Another aspect of the invention as set forth above is a vacuum pump, wherein: when the power supply of the power supply device is in the OFF state, the valve is fully closed.

The present invention makes it possible to prevent the occurrence of condensation within the power supply device.

The invention also prevents the flow of the cooling medium after the operation of the vacuum pump has been stopped when condensation occurs, preventing a negative effect on the durability of the vacuum pump when a structure is used wherein the power supply device and the vacuum pump are cooled by a cooling medium that flows through a shared cooling medium duct.

The invention further enables the user to be notified of the occurrence of condensation, and when condensation continues to occur after the notification of the occurrence of condensation, then the flow of the cooling medium is stopped after stopping the operation of the vacuum pump. As a result, there will be no negative effect on the durability of the vacuum pump, even when the user does not perform countermeasures for the condensation.

The invention is able to suppress the occurrence of condensation by reducing the flow rate of the cooling medium while regulating the upper limit for the temperature within the power supply device when the condensation continues to occur to some degree, and, if the condensation continues to occur, stops the flow of the cooling medium after stopping the operation of the vacuum pump. As a result, the frequency with which the vacuum pump is stopped due to condensation can be reduced without a negative impact on the durability of the vacuum pump.

DETAILED DESCRIPTION OF THE INVENTION

Figure 1:
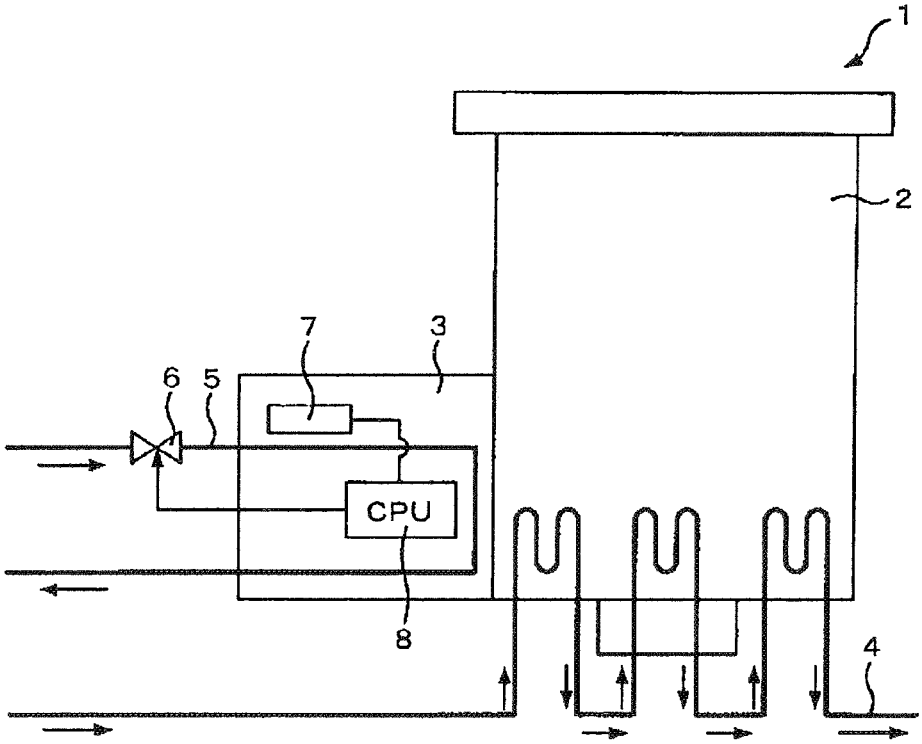
FIG. 1 is a diagram illustrating the structure of a turbomolecular pump as set forth according to the present invention.

A first embodiment of the present invention will be explained below in reference to the drawings. FIG. 1 is a drawing illustrating the structure of a turbomolecular pump 1 according to the present invention. The turbomolecular pump 1 is structured from a pump main unit 2 and a power supply device 3. The pump main unit 2 and the power supply device 3 are integrated through physical conjunction.

The pump main unit 2 includes a rotor that is formed with rotary vanes, a motor that drives the rotor rotationally, and a magnetic bearing, not shown, for supporting the rotor through magnetic levitation. Moreover, the pump main unit 2 also comprises a heating device, not shown, which uses a heater, and a cooling water duct 4. The cooling water duct 4 is a water duct for carrying a flow of cooling water within the pump main unit. The heating by the heating device and the cooling by the cooling water causes the temperature of the pump main unit 2 to be maintained at a high temperature (for example, between 50 and 70° C.). Moreover, the motor that drives the rotor rotationally and the magnetic bearing are cooled by the cooling water that flows through the cooling water duct 4.

The power supply device 3 performs driving control of the motor and the magnetic bearing in the pump main unit 2. The power supply device 3 is provided with a cooling water duct 5, a cooling water valve 6, a condensation sensor 7, and a central processing device (CPU) 8. The cooling water duct 5 is a water duct for carrying the flow of cooling water within the power supply device. The cooling water valve 6 is a magnetic valve for controlling the flow rate of the cooling water that flows in the cooling water duct 5. When the cooling water valve 6 is open, then the cooling water flows to the interior of the power supply device through the cooling water duct 5, and when the cooling water valve 6 is closed, the flow of the cooling water to the interior of the power supply device is stopped.

The condensation sensor 7 is a sensor for detecting condensation within the power supply device. An electrical resistance system or a crystal oscillator system, for example, may be used for the condensation sensor 7. When condensation is detected, the condensation sensor 7 outputs a condensation-detected signal to the CPU 8, and when condensation is not detected, the condensation sensor 7 outputs a condensation-not-detected signal to the CPU 8. The CPU 8 is a control device for controlling the opening/closing of the cooling water valve 6 based on the signals that are outputted from the condensation sensor 7.

Figure 2:
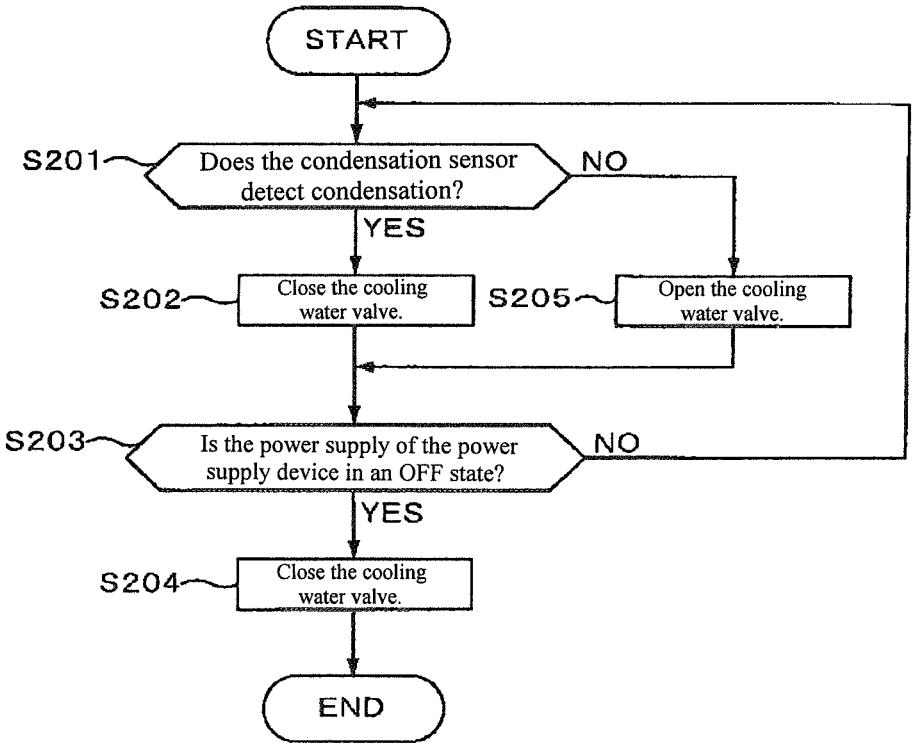
FIG. 2 is a flow chart for explaining the process for opening/closing the cooling water valve.

The opening/closing process for the cooling water valve 6 according to the present invention will be explained next in reference to the flow chart in FIG. 2. The process in FIG. 2 is executed in the CPU 8 through a program that is started when the power supply in the power supply device 3 is turned ON.

In Step S201, a determination is made, based on the signal outputted from the condensation sensor 7, as to whether or not the condensation sensor 7 has detected condensation. If the condensation sensor 7 has detected condensation, then Step S201 will make a positive determination, and processing will advance to Step S202. In Step S202, the cooling water valve 6 is closed, and processing advances to Step S203. If the condensation sensor 7 has not detected condensation, then Step S201 makes a negative determination, and processing advances to Step S205. In Step S205, the cooling water valve 6 is opened, and processing advances to Step S203.

In Step S203, a determination is made as to whether or not the power supply in the power supply device 3 is in an OFF state. If the power supply in the power supply device 3 is not in the OFF state, then Step S203 makes a negative determination, and processing returns to Step S201. If the power supply in the power supply device 3 is in the OFF state, then Step S203 makes a positive determination, and processing advances to Step S204. In Step S204, the cooling water valve 6 is closed, concluding the process for controlling the opening/closing of the cooling water valve 6.

The invention described above, has effects in operation such as the following:

When a condensation sensor 7 is equipped within the power supply device 3 and the condensation sensor 7 detects condensation, then the flow of the cooling water for cooling the power supply device 3 is terminated. Doing so makes it possible to eliminate, through the heat that is generated by the power supply device 3, the condensation that has occurred within the power supply device 3, thereby making it possible to prevent malfunction of the power supply device 3 that would occur due to condensation.

The flow of the cooling water for cooling the power supply device 3 was stopped when the power supply for the power supply device 3 was in the OFF state. Doing so makes it possible to prevent in advance the occurrence of condensation within the power supply device 3 while the power supply device 3 is stopped. This is because the condensation cannot be detected by the condensation sensor 7 while the power supply device 3 is stopped, and also because, while the power supply device 3 is stopped, the power supply device 3 does not produce heat, making it impossible to eliminate condensation that has occurred.

Figure 3:
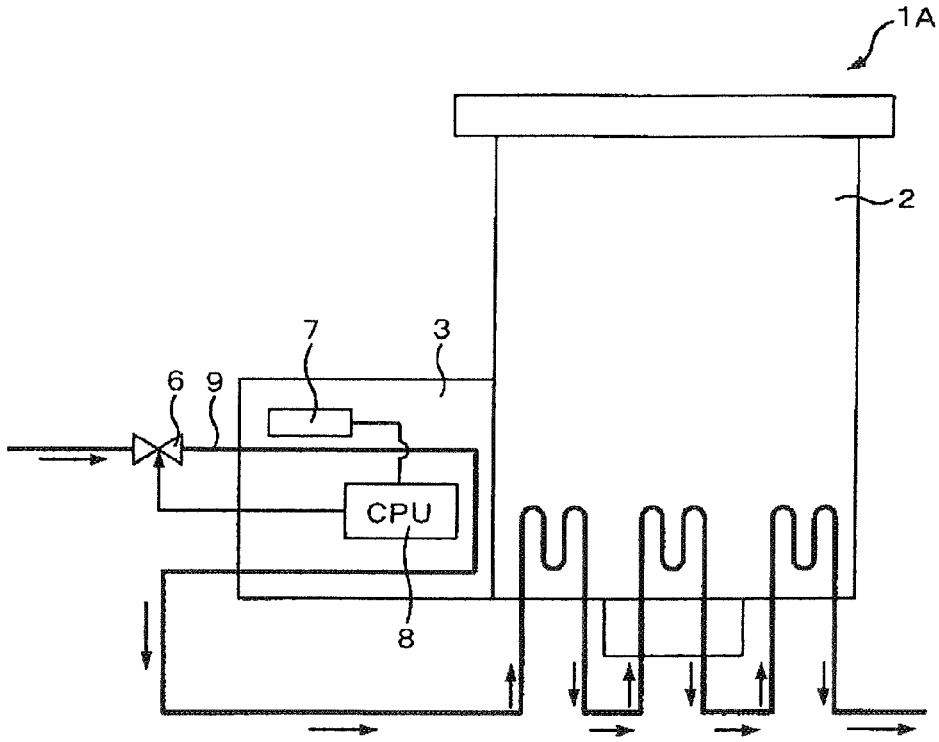
FIG. 3 is a diagram illustrating the structure of a turbomolecular pump as set forth in another form according to the present invention.

Another form of the present invention will be explained below in reference to the drawings. Those parts that are different from those in the above form will be explained primarily. In the second form of embodiment, not only is cooling performed by cooling water that flows through a cooling water duct 9 that is shared by the pump main unit 2 and the power supply device 3, but also the cooling water valve 6 is controlled in accordance with the state of operation of the turbomolecular pump. FIG. 3 is a diagram illustrating the structure of a turbomolecular pump 1A as set forth below according to the present invention. The opening/closing of the cooling water valve 6 controls the amount of flow of the cooling water through not only the interior of the power supply device, but through the interior of the pump main unit as well. That is, when the cooling water valve 6 is opened the cooling water flows through the interior of the power supply device and the interior of the pump main unit through the cooling water duct 9, and when the cooling water valve 6 is closed, the flow of the cooling water to the interior of the power supply device and to the interior of the pump main unit is terminated.

Figure 4:
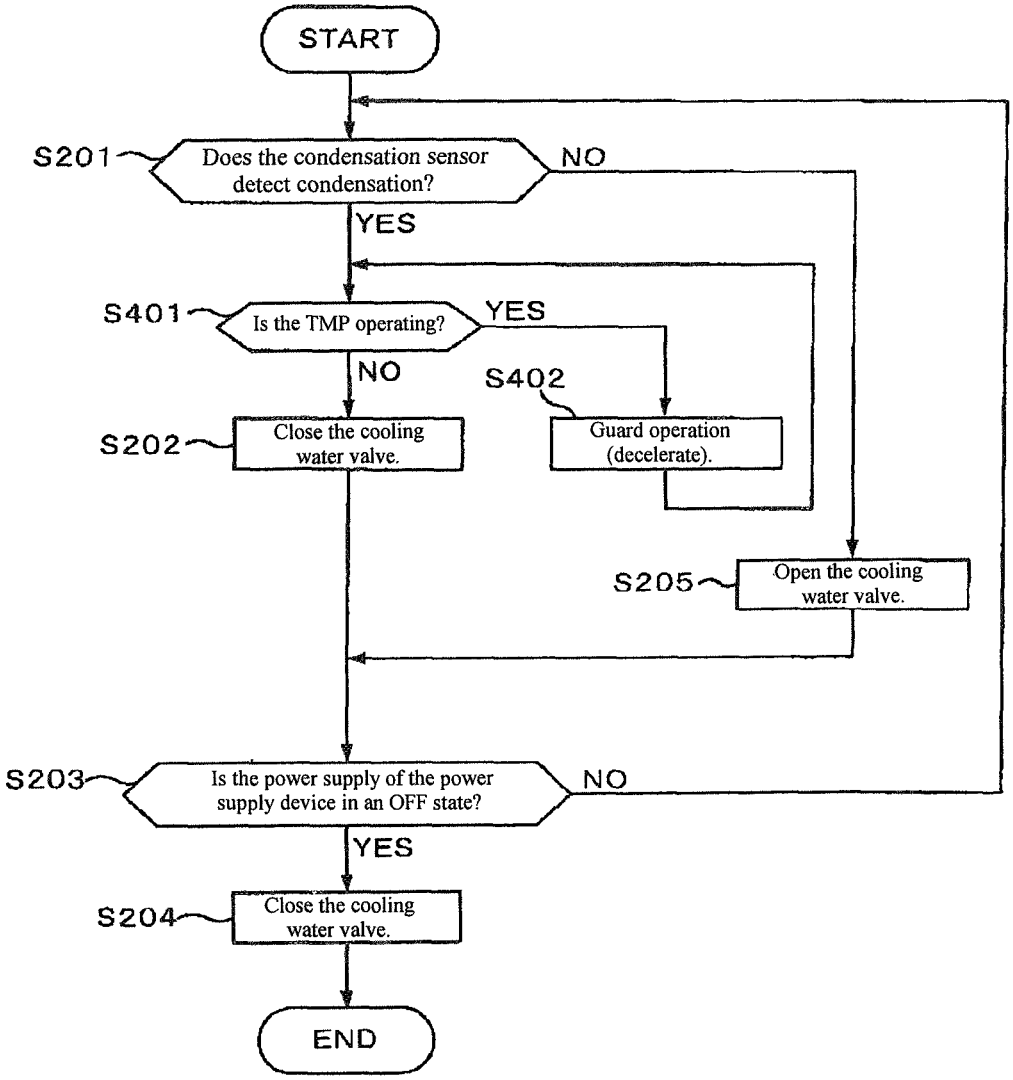
FIG. 4 is a flow chart for explaining another process for opening/closing the cooling water valve according to the present invention.

The opening/closing process for the cooling water valve 6 in this form will be explained next in reference to the flow chart in FIG. 4. The process in FIG. 4 is executed in the CPU 8 through a program that is started when the power supply in the power supply device 3 is turned ON. Identical codes are assigned to those steps in a process that are identical to the process for opening/closing the cooling water valve 6 as set forth above and the explanation will be primarily of those parts that are different from the process for opening/closing the cooling water valve 6 as set forth above.

When there is a positive determination in Step S201, processing advances to Step S401. In Step S401, a determination is made as to whether or not the TMP (turbomolecular pump 1) is operating. If the TMP is not operating, then Step S401 makes a negative determination, and processing advances to Step S202. If the TMP is operating, then Step S401 makes a positive determination, and processing advances to Step S402.

In Step S402, a guard operation is performed to decelerate the rotational velocity of the rotor so as to not suddenly apply a large torque from the rotor, which is rotating at a high speed, to the pump main unit 2. Following this, processing returns to Step S401.

The above has the following effects in operation:

When a condensation sensor 7 is equipped within the power supply device 3 and the condensation sensor has detected condensation, the rotor of the vacuum pump main unit 2 is decelerated, and then, after the rotor has stopped (after the operation of the turbomolecular pump 1 has been stopped), then the flow of the cooling water for cooling the power supply device 3 is stopped. Doing so not only prevents an increase in the temperature of the pump main unit 2 to prevent a negative impact on the durability of the pump main unit 2, but also makes it possible to prevent malfunctioning of the power supply device 3 caused by the condensation.

Figure 5:
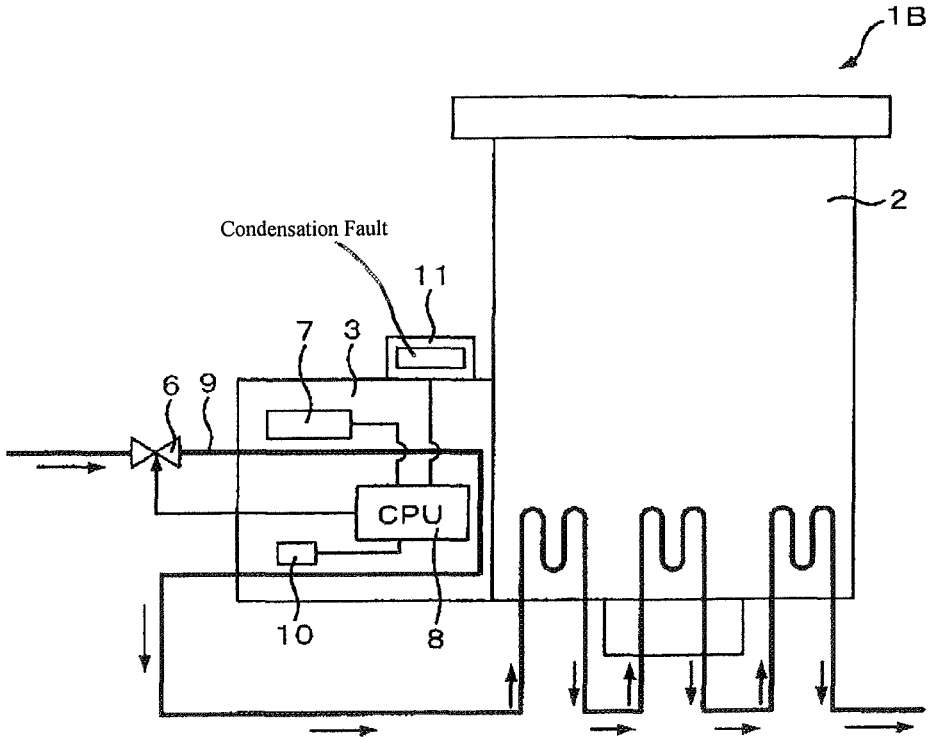
FIG. 5 is a diagram illustrating the structure of a turbomolecular pump as set forth in a further form according to the present invention.

A further form of the present invention will be described below in reference to the drawings. The parts that are different from the above will be explained primarily. FIG. 5 is a diagram illustrating the structure of a turbomolecular pump 1B as set forth in the present form of the invention. Note that after the condensation is detected by the condensation sensor 7, it takes several dozen minutes with the condensation advancing before a malfunction would occur in the power supply device 3. During this time period it is possible to eliminate the condensation within the power supply device, without stopping the operation of the turbomolecular pump, through reducing the flow of the cooling water or increasing the temperature of the cooling water. Because of this, the user is notified of the occurrence of condensation within the power supply device to enable the user to take measures against the condensation within the power supply device.

In the turbomolecular pump 1B as set forth in includes a condensation counter 10 and a display device 11 in the power supply device 3, in addition to the structure of the turbomolecular pump 1A as set forth above. The condensation counter 10 is a device for timing the time duration over which condensation occurs. The CPU 8 increments the time of the condensation counter 10 during the time period wherein the condensation sensor 7 detects the condensation, and, during the interval over which the condensation sensor 7 does not detect condensation, decrements the time of the condensation counter 10. For example, if 10 minutes elapse since the detection of condensation by the condensation counter, then the time timed by the condensation counter 10 goes to 10 minutes, and if, thereafter, the condensation sensor does not detect condensation for five minutes, then the time timed by the condensation counter 10 goes to 10 minutes−5 minutes=5 minutes. The condensation counter 10 is structured so as to not assume a negative time. The display device 11 is a device for notifying the user of the occurrence of condensation within the power supply device by displaying "Condensation Fault" on a display screen.

Figure 6:
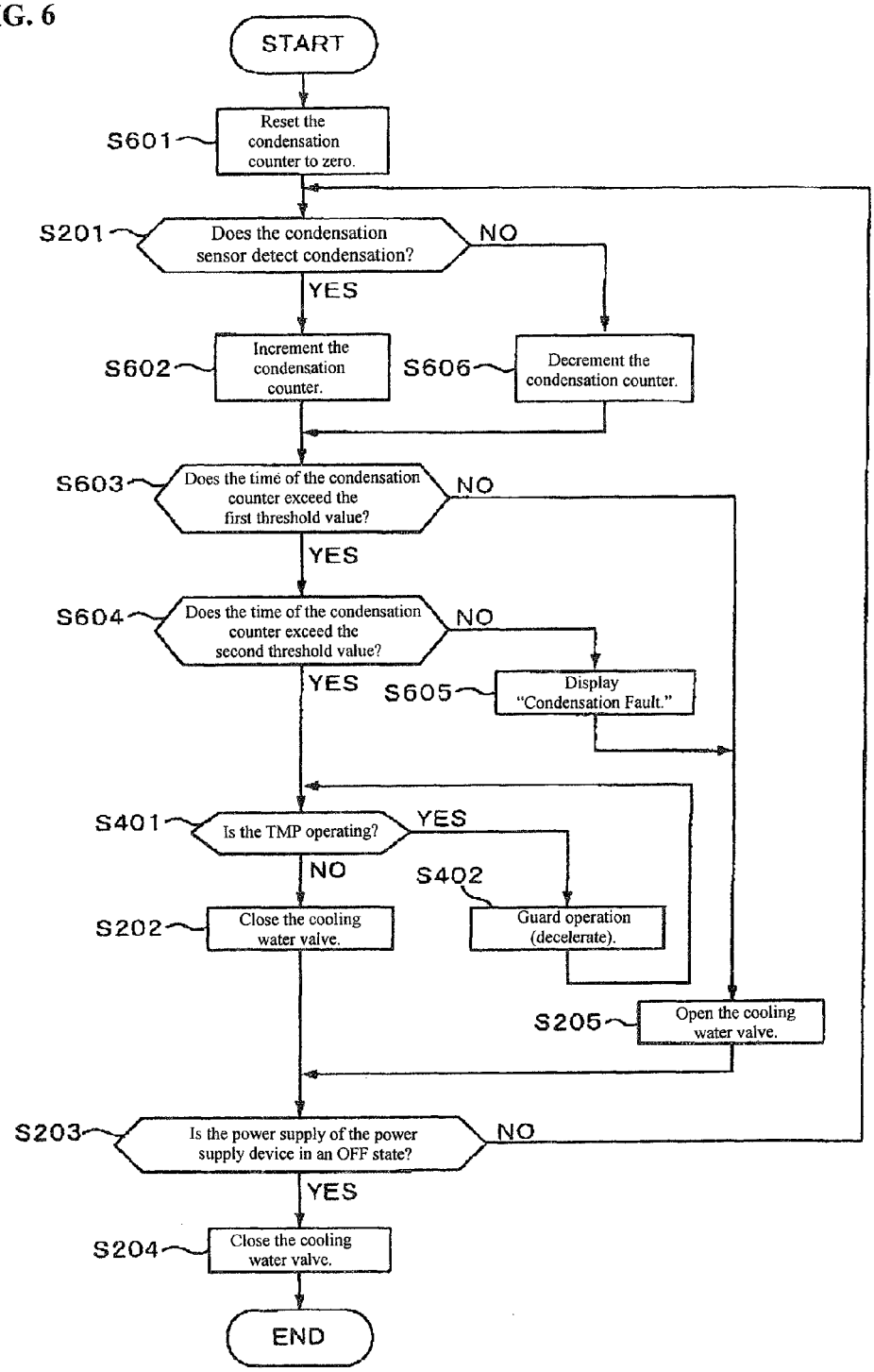
FIG. 6 is a flow chart for explaining the process for opening/closing the cooling water valve according to the present invention.

The opening/closing process for the cooling water valve 6 in this form of the present invention will be explained next in reference to the flow chart in FIG. 6. The process in FIG. 6 is executed in the CPU 8 through a program that is started when the power supply in the power supply device 3 is turned ON. Identical codes are assigned to those steps in a process that are identical to the process for opening/closing the cooling water valve 6 as set forth above, and the explanation will be primarily of those parts that are different from the process for opening/closing the cooling water valve 6 as set forth above.

In Step S601 the condensation counter 10 is reset to zero. Processing then advances to Step S201. When Step S201 makes a positive determination, processing advances to Step S602, and the condensation counter 10 is incremented, and processing advances to Step S603. When Step S201 makes a negative determination, processing advances to Step S606, and the condensation counter is decremented, and processing advances to Step S603.

In Step S603 a determination is made as to whether or not the time of the condensation counter 10 has exceeded a first threshold value. The first threshold value is, for example, one minute. If the time of the condensation counter 10 has exceeded the first threshold value, then Step S603 makes a positive determination, and processing advances to Step S604. If the time of the condensation counter 10 has not exceeded the first threshold value, then Step S603 makes a negative determination, and processing advances to Step S205.

In Step S604 a determination is made as to whether or not the time of the condensation counter 10 has exceeded a second threshold value. The second threshold value is larger than the first threshold value, where the second threshold value is, for example, 20 minutes. If the time of the condensation counter 10 has exceeded the second threshold value, then Step S604 makes a positive determination, and processing advances to Step S401. If the time of the condensation counter 10 has not exceeded the second threshold value, then Step S604 makes a negative determination, and processing advances to Step S605. In Step S605, "Condensation Fault" is displayed on the display screen of the display device 11. Processing then advances to Step S205.

As set forth above, the invention has, in addition to operating effects that are identical to those already noted, operating effects such as the following:

The user is notified of the occurrence of condensation within the power supply device. This enables the user to take measures to eliminate the condensation within the power supply device, without stopping the cooling water that flows into the pump main unit. As measures by which to eliminate the condensation within the power supply device, the flow rate of the cooling water that flows in the cooling water duct 9 may be reduced, measures may be taken to increase the temperature of the cooling water, or the like. If the flow rate of the cooling water is to be adjusted, a flow rate adjusting valve is used for the cooling water valve 6.

The user is notified of the occurrence of condensation within the power supply device when the measured time by the condensation counter 10, which increments and detriments the time interval for the occurrence of condensation depending on whether or not condensation is detected by the condensation sensor 7, exceeds the first threshold. Doing so enables the user to be notified of the occurrence of condensation within the power supply device with appropriate timing. For example, notifications due to spurious detection of condensation can be prevented through notifying the user of the occurrence of condensation within the power supply device only after the condensation sensor 7 has detected the occurrence of condensation over a time interval according to the first threshold value.

The cooling water valve 6 is forcibly closed when the measured time interval by the condensation counter 10, which increments and detriments the time interval of the occurrence of condensation depending on whether or not the condensation sensor 7 detects condensation, exceeds a second threshold value (which is greater than the first threshold value). Doing so makes it possible to prevent the occurrence of a malfunction in the power supply device 3 due to the occurrence of condensation even when the measures by the user for eliminating the condensation within the power supply device are not prompt enough to prevent the progression of the condensation, and even when the measures taken by the user to eliminate the condensation within the power supply device are unable to eliminate the condensation within the power supply device.

Figure 7:
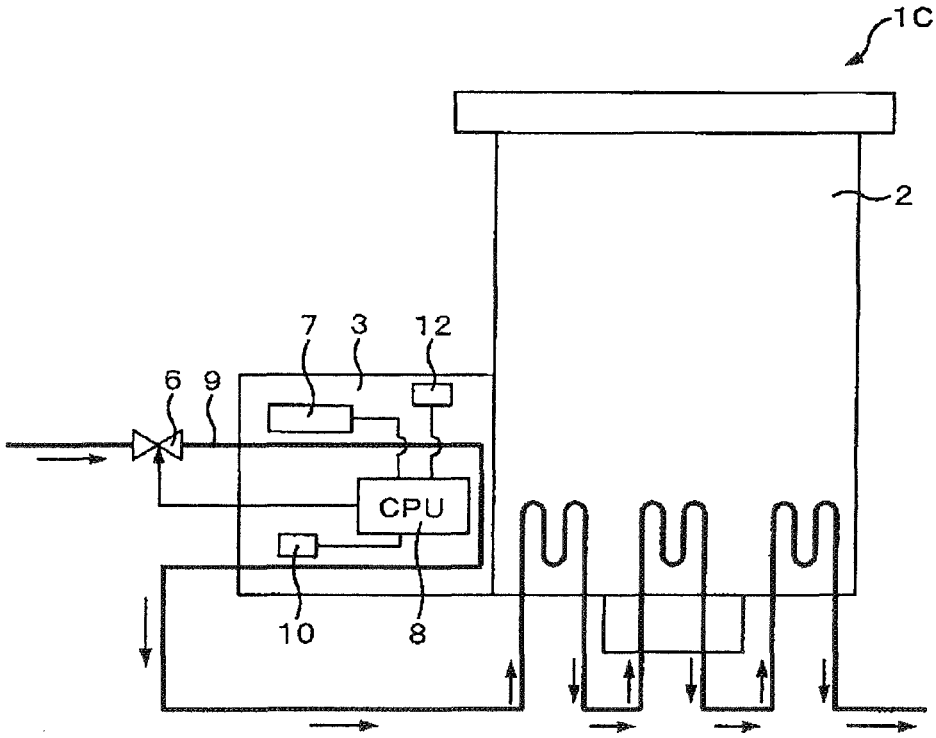
FIG. 7 is a diagram illustrating the structure of a turbomolecular pump according to the present invention.

Another form embodying the present invention will be described below in reference to the drawings. The parts that are different from the above will be explained primarily. FIG. 7 is a diagram illustrating the structure of a turbomolecular pump 1C as set forth below. The structure of the turbomolecular pump 1C is different from the structure of the turbomolecular pump 1B in the point that a temperature sensor 12 is provided in the power supply device 3. The temperature sensor 12 measures the temperature within the power supply device and outputs the measurement results to the CPU 8. Additionally, a flow rate adjusting valve is used for the cooling water valve 6.

Figure 8:
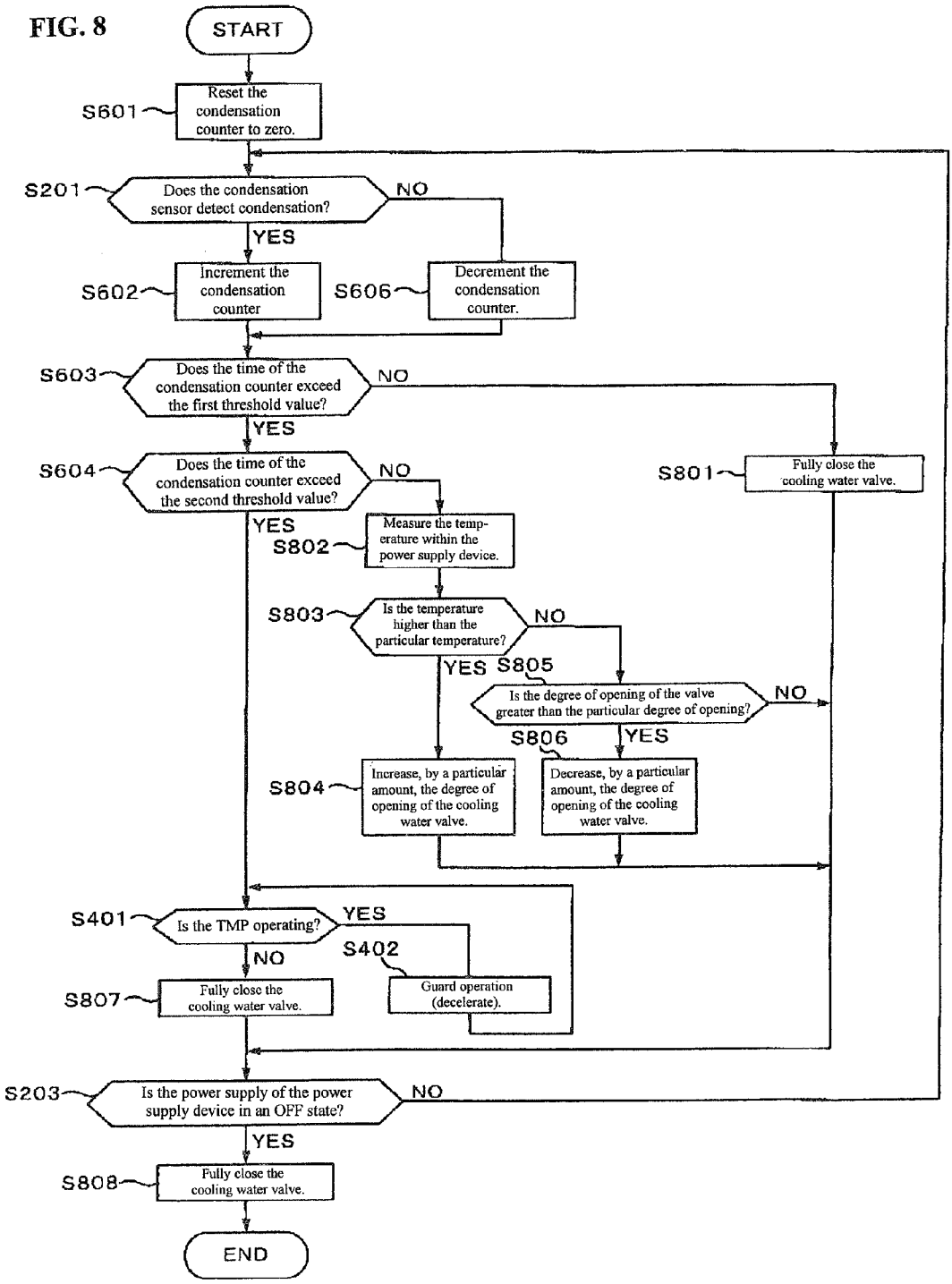
FIG. 8 is a flow chart for explaining the process for opening/closing the cooling water valve according to the present invention.

The opening/closing process for the cooling water valve 6 according to the present invention will be explained next in reference to the flow chart in FIG. 8. The process in FIG. 8 is executed in the CPU 8 through a program that is started when the power supply in the power supply device 3 is turned ON. Identical codes are assigned to those steps in a process that are identical to the process for opening/closing the cooling water valve 6 as set forth above, and the explanation will be primarily of those parts that are different from the process for opening/closing the cooling water valve 6 as set forth above.

When Step S603 makes a negative determination, processing advances to Step S801. In Step S801, the cooling water valve 6 is closed completely. Processing then advances to Step S203.

When Step S604 makes a negative determination, processing advances to Step S802. In Step S802, the temperature within the power supply device is measured by the temperature sensor 12. In Step S803, a determination is made, based on the temperature measured by the temperature sensor 12, as to whether or not to the temperature within the power supply device is higher than a particular temperature. The particular temperature is, for example, an upper limit temperature for the temperature within the power supply device whereat the power supply device 3 can operate with stability. If the temperature within the power supply device is higher than the particular temperature, then Step S803 makes a positive determination and processing advances to Step S804. If the temperature within the power supply device is at or lower than the particular temperature, then Step S803 makes a negative determination, and processing advances to Step S805.

In the Step S804, the degree of opening of the cooling water valve 6 is increased by a particular amount, and processing advances to Step S203. In Step S805, a determination is made as to whether or not the degree of opening of the cooling water valve 6 is greater than a particular degree of opening. The particular degree of opening is a degree of opening of the cooling water valve 6 wherein the flow rate of the cooling water that is required to at least cool the pump main unit 2 is maintained. If the degree of opening of the cooling water valve 6 is greater than the particular degree of opening, then Step S805 makes a negative determination, and processing advances to Step S806. If the degree of opening of the cooling water valve 6 is no more than the particular degree of opening, then Step S805 makes a negative determination, and processing advances to Step S203. In Step S806, the degree of opening of the cooling water valve 6 is decreased by a particular amount, and processing advances to Step S203. The lower limit value for the degree of opening of the cooling water valve 6 is controlled to a particular degree of opening by the determination process in Step S805. This makes it possible to prevent an increase in the temperature in the pump main unit 2.

When Step S401 makes a negative determination, processing advances to Step S807, the cooling water valve 6 is closed completely, and processing advances to Step S203. When Step S203 makes a positive determination, processing advances to Step S808, the cooling water valve 6 is closed completely, and the process for opening/closing the cooling water valve 6 is terminated.

As set forth above, the invention has, in addition to operating effects of the other inventions operating effects such as the following: When condensation occurs within the power supply device, the flow rate of the cooling water that flows through the interior of the power supply device and through the interior of the pump main unit is adjusted. Doing so enables measures to be taken to eliminate the condensation within the power supply device without stopping the cooling water that flows through the pump main unit.

The adjustment of the flow rate of the cooling water is started when the time measured by the condensation counter 10, which increments and decrements the time interval of the occurrence of condensation depending on whether or not the condensation sensor 7 detects condensation, exceeds a first threshold value. Doing so enables the adjustments of the flow rate of the cooling water to be started with an appropriate timing. For example, the commencement of the adjustment of the flow rate due to a spurious condensation detection can be prevented through starting the adjustment of the flow rate of the cooling water only after the condensation sensor 7 has detected the occurrence of condensation over time interval according to the first threshold value.

The cooling water valve 6 is forcibly fully closed when the measured time interval by the condensation counter 10, which increments and detriments the time interval of the occurrence of condensation depending on whether or not the condensation sensor 7 detects condensation, exceeds a second threshold value (which is greater than the first threshold value). Doing so makes it possible to prevent the occurrence of malfunctions in the power supply 3 due to condensation, even when the condensation within the power supply device could not be eliminated through adjusting the flow rate of the cooling water.

The vacuum pumps can be modified as follows:

The flow of cooling water in the power supply device was stopped in Step S202 of the process for opening/closing the cooling water valve 6 in the first few examples and in Step S806 and the process for opening/closing the cooling water valve 6 in the above example. However, rather than stopping the flow of the cooling water in the power supply device, instead the flow rate of the cooling water may be reduced. Reducing the flow rate of the cooling water reduces the cooling effect due to the cooling water within the power supply device, enabling the condensation that has occurred within the power supply device 3 to be eliminated by the heat generated by the power supply device 3.

In one form, the user was notified of the occurrence of condensation within the power supply device through the display of the display device 11. However, insofar as the user is notified of the occurrence of condensation within the power supply device, there is no limitation to the display of the display device 11. For example, the notification may instead be through a sound emitted from a speaker.

The cooling medium for cooling the pump main unit 2 and the power supply device 3 is not limited to cooling water, insofar as it is able to cool the pump main unit 2 and the power supply device 3. Additionally, the pump main unit 2 may be air-cooled and the power supply device 3 may be water-cooled.

The explanations above are no more than examples, and in no wise is the present invention limited to the forms set forth above. Consequently, the present invention may be applied also to other vacuum pumps that are integrated with power supply devices or that are provided in the vicinity of power supply devices, rather than being limited to the turbomolecular pump 1.

The invention claimed is:

1. A vacuum pump comprising a power supply device that is integrated with a pump main unit, comprising:

a cooling medium duct configured to carry a flow of a cooling medium within the pump main unit and the power supply device;

a valve configured to adjust the flow of the cooling medium in the cooling medium duct within the pump main unit and the power supply device;

a condensation sensor configured to detect condensation within the power supply device; and a controller configured to control the opening/closing of the valve; wherein:

the controller, when the condensation sensor has detected condensation within the power supply device, fully closes the valve after stopping the operation of the vacuum pump.

2. A vacuum pump comprising a power supply device that is integrated with a pump main unit, comprising:

a cooling medium duct configured to carry a flow of a cooling medium within the pump main unit and the power supply device;

a valve configured to adjust the flow of the cooling medium in the cooling medium duct within the pump main unit and the power supply device;

a condensation sensor configured to detect condensation within the power supply device;

a timer configured to time a condensation occurrence time by increasing the condensation occurrence time while the condensation sensor is detecting condensation within the power supply device and decreasing the condensation occurrence time while the condensation sensor is not detecting condensation within the power supply device;

a notifyer configured to provide a notification that condensation has occurred; and a controller configured to control the opening/closing of the valve; wherein:

the notifyer provides notification of the condensation when the condensation occurrence time that has been timed by the timer exceeds a first threshold value; and the controller fully closes the valve after stopping the operation of the vacuum pump when the condensation occurrence time that has been timed by the timer exceeds a second threshold value, which is greater than the first threshold value.

3. A vacuum pump comprising a power supply device that is integrated with a pump main unit, comprising:

a cooling medium duct configured to carry a flow of a cooling medium within the pump main unit and the power supply device;

a valve configured to adjust the flow of the cooling medium in the cooling medium duct within the pump main unit and the power supply device;

a condensation sensor configured to detect condensation within the power supply device;

a timer configured to time a condensation occurrence time by increasing the condensation occurrence time while the condensation sensor is detecting condensation within the power supply device and decreasing the condensation occurrence time while the condensation sensor is not detecting condensation within the power supply device;

a temperature sensor configured to measure the temperature within the power supply device; and a controller configured to control the opening/closing of the valve; wherein:

the controller, when the condensation occurrence time that has been timed by the timer exceeds a first threshold value, reduces the cooling medium flow rate within a range wherein the temperature within the power supply device, measured by the temperature sensor, is in a range that does not exceed a particular temperature, and when the condensation occurrence time timed by the timer exceeds a second threshold value, which is greater than the first threshold value, fully closes the valve after stopping the operation of the vacuum pump.

4. The vacuum pump as set forth in claim 1, wherein: when the power supply of the power supply device is in the OFF state, the valve is fully closed.

5. The vacuum pump as set forth in claim 2, wherein: when the power supply of the power supply device is in the OFF state, the valve is fully closed.

6. The vacuum pump as set forth in claim 3, wherein: when the power supply of the power supply device is in the OFF state, the valve is fully closed.

* * * * *